US005718175A

United States Patent [19]

Guaraldi et al.

[11] Patent Number: 5,718,175

[45] Date of Patent: Feb. 17, 1998

[54] METHOD AND APPARATUS FOR MOUNTING A PRINTING PLATE ON A CYLINDER

[75] Inventors: Glenn Alan Guaraldi, Kingston; Warren Hess Jarrard, Rochester, both of N.H.

[73] Assignees: Heidelberger Harris Inc., Dover, N.H.; Heidelberger Druckmaschinen Aktiengesellschaft, Heidelberg, Germany

[21] Appl. No.: 710,005

[22] Filed: Sep. 11, 1996

Related U.S. Application Data

[63] Continuation of Ser. No. 429,491, Apr. 26, 1995, abandoned.

[51] Int. Cl.[6] ..... B41F 27/06

[52] U.S. Cl. ..... 101/477; 101/415.1

[58] Field of Search ..... 101/477, 415.1, 101/216, 378, DIG. 36

[56] References Cited

U.S. PATENT DOCUMENTS

| | | | |
|---|---|---|---|
| 4,577,560 | 3/1986 | Banike | 101/415.1 |
| 5,094,164 | 3/1992 | Kowalczk et al. | 101/401.1 |
| 5,211,112 | 5/1993 | Tsushima et al. | 101/415.1 |
| 5,284,093 | 2/1994 | Guaraldi et al. | 101/415.1 |
| 5,309,832 | 5/1994 | Merkel et al. . | |
| 5,335,046 | 8/1994 | Bosy | 101/415.1 |
| 5,339,738 | 8/1994 | Blaser et al. | 101/477 |
| 5,383,402 | 1/1995 | Takano et al. | 101/477 |
| 5,406,888 | 4/1995 | Sugiyama et al. | 101/477 |
| 5,460,092 | 10/1995 | Beisel et al. | 101/477 |
| 5,467,711 | 11/1995 | Maejima | 101/216 |
| 5,479,859 | 1/1996 | Lindner et al. | 101/415.1 |
| 5,511,478 | 4/1996 | Lindner et al. | 101/477 |
| 5,549,045 | 8/1996 | D'Heureuse et al. | 101/477 |

FOREIGN PATENT DOCUMENTS

| | | |
|---|---|---|
| 0 531 748A1 | 3/1993 | European Pat. Off. . |
| 0 551 166A1 | 7/1993 | European Pat. Off. . |
| 0 639 454A1 | 2/1995 | European Pat. Off. . |
| 0 712 725 | 5/1996 | European Pat. Off. . |
| 2 754 080 | 6/1979 | Germany . |

*Primary Examiner*—Eugene H. Eickholt

*Attorney, Agent, or Firm*—Burns, Doane, Swecker and Mathis, L.L.P.

[57] ABSTRACT

The present invention relates to a method and apparatus for mounting a printing plate on a printing unit cylinder's surface, the printing unit cylinder having an open passage in a retaining area of the printing unit cylinder. Within the open passage a lock-up bar is slidably mounted. The lock-up bar includes an element for retaining at least one edge of the printing plate. A tucking device assigned to the printing unit cylinder has a tucker bar substantially covering the retaining area of the printing plate.

31 Claims, 5 Drawing Sheets

METHOD AND APPARATUS FOR MOUNTING A PRINTING PLATE ON A CYLINDER

This application is a continuation of application Ser. No. 08/429,491, filed Apr. 26, 1995 now abandoned.

BACKGROUND OF THE INVENTION

1. Field of the Invention

The present invention relates to a method and apparatus for mounting a printing plate on a cylinder.

2. State of the Art

U.S. Pat. No. 5,284,093 discloses a plate cylinder with semi-automatic plate lock-up. As disclosed therein, a rotatable plate cylinder for supporting a printing plate has an open passage and a locking member supported for movement in the passage. The locking member is movable inward of the passage to a closed position, and is movable outward of the passage to an open position. The locking member is subjected to a first centrifugal force which urges it to move outward from the closed position when the plate cylinder rotates. A balance member is subjected to a second centrifugal force when the plate cylinder rotates. Connecting pins direct the second centrifugal force against the locking member opposite to the first centrifugal force.

U.S. Pat. No. 4,577,560 discloses a gapless lock-up for offset printing cylinders. As disclosed therein, a fixed jaw and a movable jaw are set into a cylinder of a rotary offset printing machine. They include facing undercut surfaces that define a recess within which end tabs of an offset plate or metal backed blanket are clamped firmly between the jaws. A slight tendency of the end tabs to bulge at the outer margin of the jaws is overcome by an anti-creep means which is distorted between the end tabs as the jaws close so as to produce an inward force component on the end tabs.

European Patent Application No. 0 531 748 A1 discloses a device for a plate exchange. A roller mounted in a sliding means is disposed opposite a clamping device in a gap of a printing unit cylinder. The outer circumference of the roller contacts the trailing edge of a printing plate upon movement of the roller perpendicular to the printing unit cylinder. Since the roller only covers a linear area, it is difficult to use the roller for smoothly contacting a printing plate's leading and trailing edges simultaneously.

U.S. Pat. No. 5,211,112 discloses an apparatus for mounting a plate on a plate cylinder. The apparatus includes a pair of right and left support levers, a plate press roller and a plate press pad having a spring member. The plate press roller urges the plate against the circumferential surface of the plate cylinder when the plate is wound on the plate cylinder. The plate press pad is fixed on a holding member to couple free end portions of the pair of support levers, and has an elastic surface for pressing a trailing-side of the plate.

European Patent Application No. 0 551 166 A1 shows a plate exchange apparatus for printing presses. Operating members, including a plate press roller, are assigned to a circumferential surface of a plate cylinder. The plate press roller inserts a leading end portion of a printing plate into gripper surfaces of a leading-side plate lock-up device, and inserts a trailing edge of the printing plate into gripper surfaces of a trailing side plate lock-up device assigned to the trailing edge of the printing plate. At the time the trailing edge is locked-up, the plate press roller does not urge both edges of the printing plate simultaneously into the respective plate lock-up devices with the plate cylinder in a defined rotational position. On the contrary, to allow for inserting both edges, the rotational position of the plate cylinder is changed between two defined positions during a plate exchange operation.

SUMMARY OF THE INVENTION

Accordingly, having discussed the state of the art, it is an object of the present invention to provide a method and apparatus for mounting a printing plate with a plate trailing edge contacting member.

A further object of the present invention is to achieve a smooth curvature of the printing plate which corresponds to the curvature of the plate cylinder in the plate retaining (e.g., clamping) area.

Another object of the present invention is to prevent contaminants from entering the plate mounting device.

According to the present invention an apparatus for mounting a printing plate on a printing unit cylinder comprises:

- a printing unit cylinder having an opening in a retaining area of said printing unit cylinder;
- a lock-up bar slidably mounted in said opening of said printing unit cylinder, said lock-up bar having a retaining element for retaining at least one edge of a printing plate; and
- a tucking device assigned to said printing unit cylinder and having a tucker bar substantially covering the retaining area of said printing cylinder, said tucking device being provided with a protection device.

Exemplary embodiments of the present invention allow for safe insertion of respective printing plate edges into a plate retaining mechanism. Further, because a tucker bar according to exemplary embodiments of the present invention widely covers a plate retaining area, the surface of the printing plate is smooth along the cylinder's curvature; such a feature facilitates rolling contact between the printing plate and a corresponding blanket cylinder of the printing unit. In addition, a protective device assigned to the tucking device prevents contaminants from entering between the tucking bar and the housing of the tucking device.

Furthermore, exemplary embodiments of the tucking device urge a trailing edge into a lock-up bar of a plate cylinder. The tucker bar contacts a surface of the lock-up bar during its retraction into the plate cylinder.

In exemplary embodiments, the protective device can be a protective sleeve, wrapped around the tucking device and tightly held by a spring-loaded tensioning member. The protective sleeve can, for example, be made of a rubber-like material, can be manufactured by polyurethane/polyester or the like, or can an elastic fabric. For exchanging purposes, the protective sleeve can be mounted slideably on the tucking device.

A tucker bar according to exemplary embodiments of the present invention can be moved by a piston which is energized by applying pressure (for example, air or fluid pressure) to a pressure chamber provided in a housing of said tucking device.

BRIEF DESCRIPTION OF THE DRAWINGS

The foregoing and other features of the present invention will become apparent to those skilled in the art upon reading the following description of preferred embodiments of the invention in conjunction with the accompanying drawings, wherein.

DETAILED DESCRIPTION OF THE PREFERRED EMBODIMENTS

Figure 1:
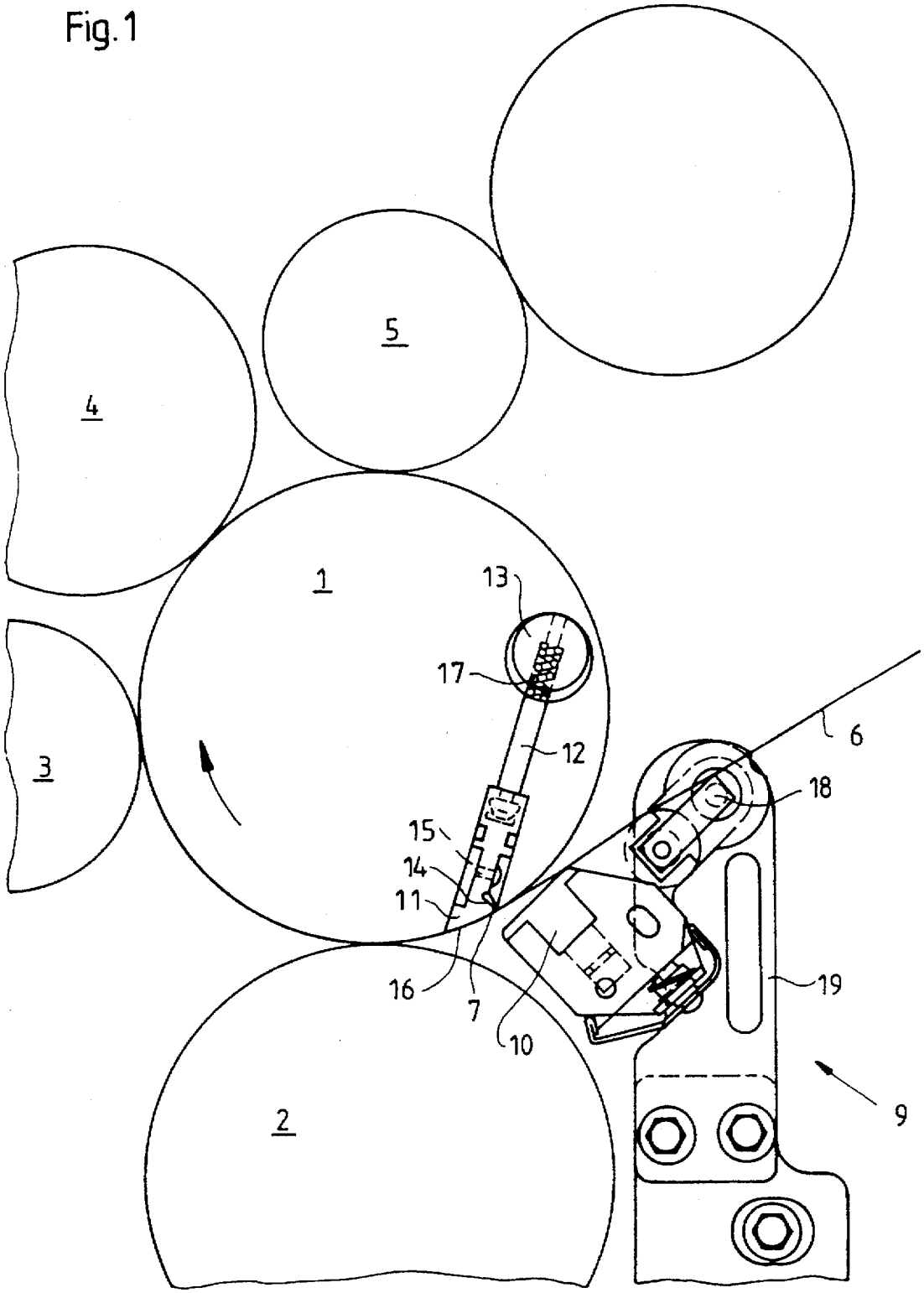
FIG. 1 is a side view of an exemplary embodiment of the present invention, showing a leading edge of a printing plate seized by a lock-up bar.

An exemplary embodiment of an apparatus according to the present invention is shown in FIG. 1 as a printing unit having a plate cylinder 1 and a blanket cylinder 2. A plate 6 is to be mounted on the circumference of the plate cylinder 1.

A first form roll 3, a second form roll 4 and a third form roll 5 are assigned to the plate cylinder for transferring ink to its surface. The plate cylinder 1 transfers an image to the blanket cylinder 2, which transfers this image onto a web of material.

The plate 6 which is to be mounted on the plate cylinder 1 includes leading edge 7 and trailing edge 8 (shown in FIG. 2) respectively, which are to be clamped by means of a lock-up bar 11. The lock-up bar 11 is mounted in an opening, represented as an open passage which receives the leading and trailing edges, within the plate cylinder 1, and includes an elongated body 12 which is connected to a balance bar 13. The balance bar 13 is loaded by springs 17, such as coil springs or the like. A retainer element, such as a retainer spring 14, is mounted on the lock-up bar 11 by means of a fastener 15 or the like.

Opposite the lock-up bar 11, which has an outer surface 16 corresponding to the plate cylinder circumference, a tucking device 9 is provided. The tucking device 9 comprises a tucking bar 10 within a support which is mounted to pivot about a pivot axis 18. The pivot axis 18 in turn is connected to a support 19 arranged below the plate 6 to be mounted on the plate cylinder 1.

In the rotational position shown in FIG. 1, the lock-up bar 11 is initially extended outwardly from the plate cylinder 1 by fluid pressure (for example, air pressure), the tucking device is swung to an open position, and a plate leading edge 7 is hooked by an outer end 25 (outer end 25 is labelled in FIG. 2) of the plate cylinder 1 and the retainer spring 14. After having inserted the plate leading edge 7, the lock-up bar 11 is retracted into the plate cylinder 1 to the retracted position and the tucking device is swung back to a closed position as shown in FIG. 1. When clamping the plate leading edge 7 with the plate cylinder 1 in the rotational position shown, tucker bar 10 remains in a retracted, closed position within the tucking device 9 as shown in FIG. 1. The plate cylinder 1 is then rotated to wrap the plate about its circumference.

Figure 2:
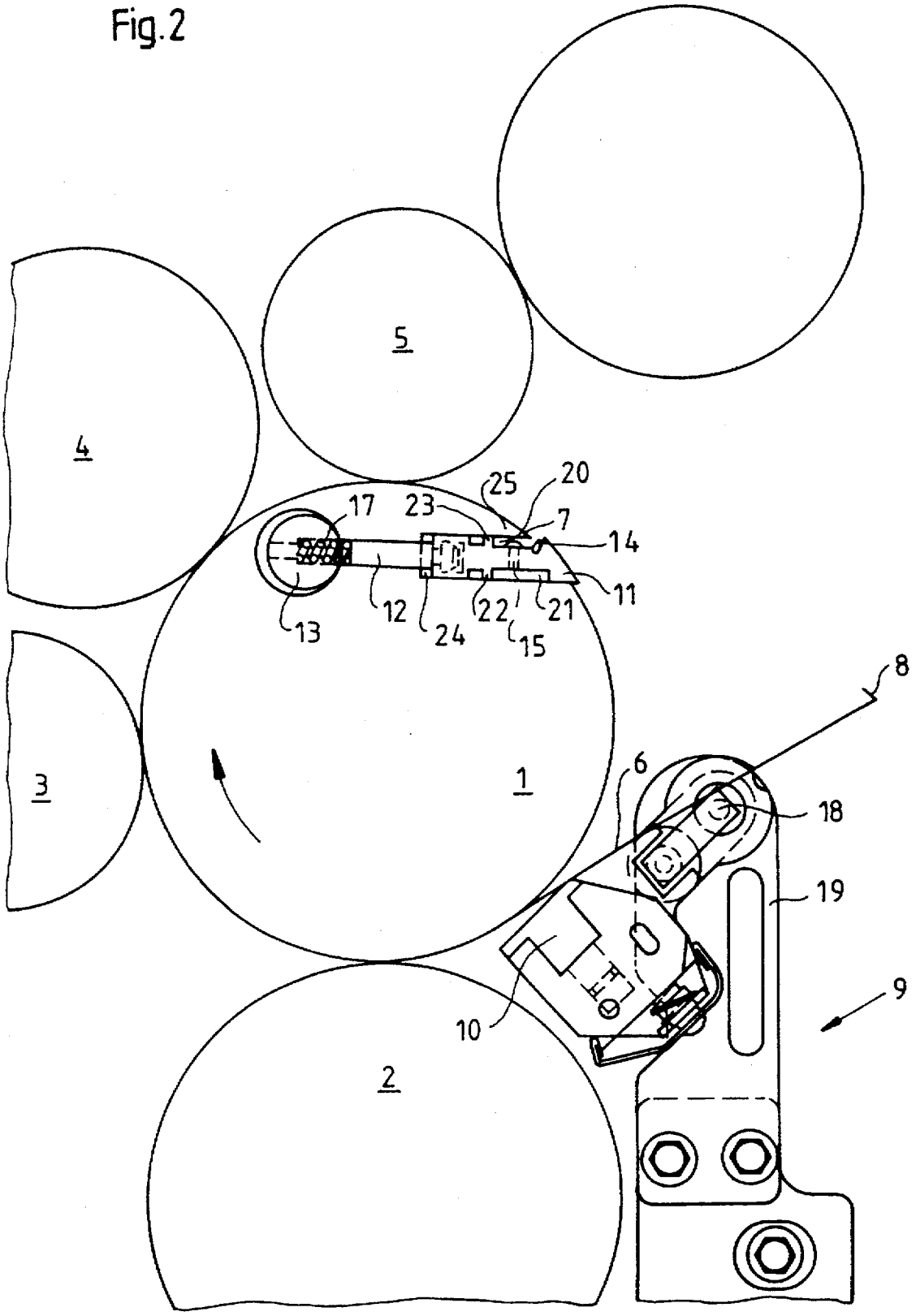
FIG. 2 shows the seized plate of FIG. 1 transported on a printing unit cylinder by rotation thereof.

FIG. 2 shows the seized plate wrapped partially around the plate cylinder 1.

After rotating the plate cylinder 1 past the first, second and third form rolls 3, 4 and 5, respectively, the lock-up bar 11 automatically extends out of the plate cylinder's circumference (for example, by fluid pressure and/or centrifugal force), while the plate cylinder 1 is still rotating. The leading edge 7 remains hooked on the outer end 25, the lock-up bar 11 having laterally moved within open passage 24 of the plate cylinder 1. The tucking device 9 maintains its downward inclined position, allowing for the plate 6 to pass a plate area between a circumference of the plate cylinder 1 and the surface of the tucker bar 10 which remains retracted in its closed, inactivated position. Thus, further rotational movement of the plate cylinder 1 wraps the plate around the plate cylinder 1 until the trailing edge 8 of the plate 6 has reached a position opposite the lock-up bar 11 of the plate cylinder 1. As shown in FIG. 2, the lock-up bar 11 further includes an upper recess 20 and a lower recess 21 within which the retainer spring 14 is mounted. Further, the lock-up bar 11 includes a stop surface 23 located opposite an end portion 22 for limiting movement of the lock-up bar 11 within the open passage 24 of the plate cylinder 1.

Figure 3:
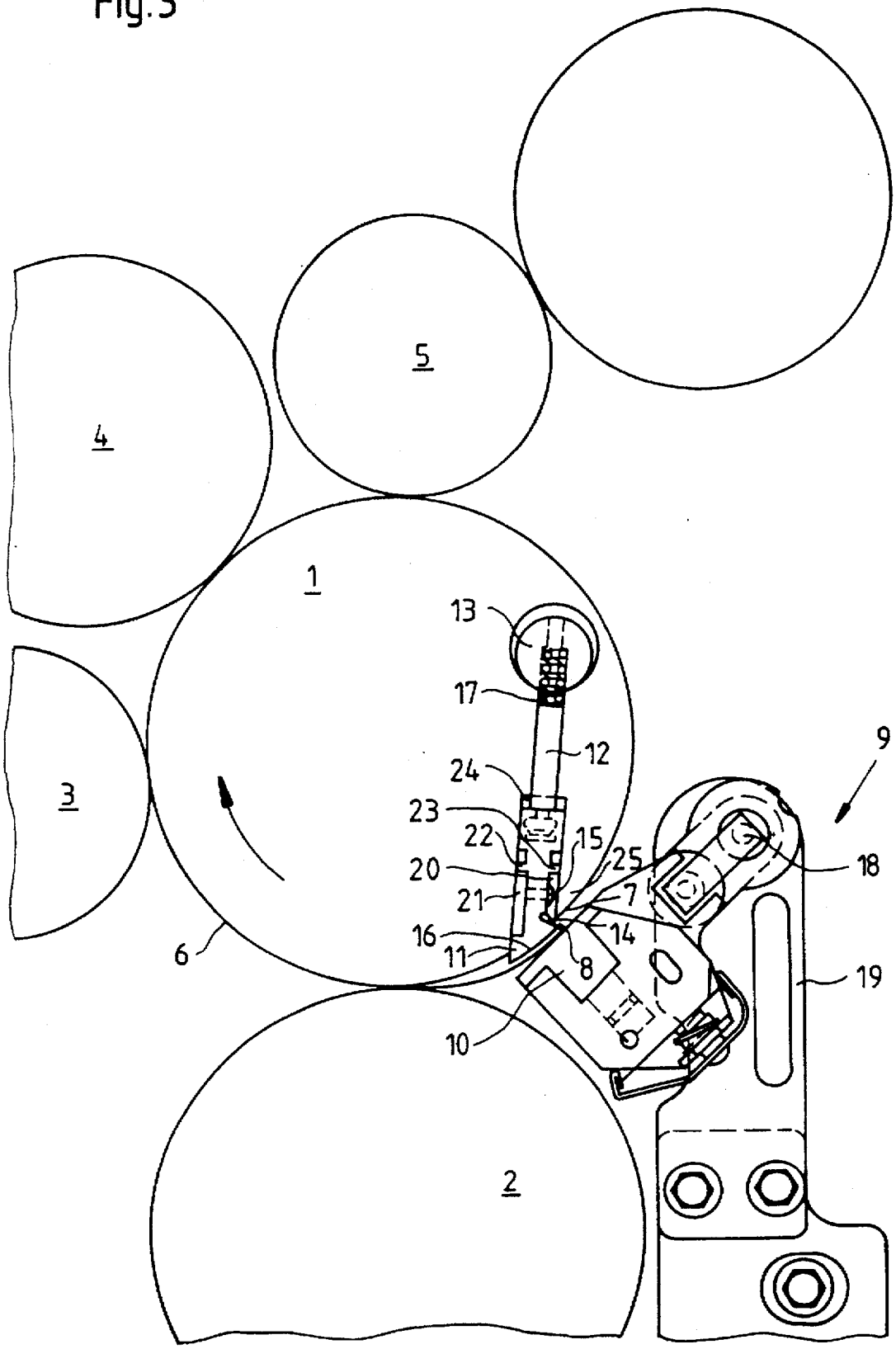
FIG. 3 shows the lock-up bar of FIG. 1 in a rotational position opposite a tucking device.

FIG. 3 shows the lock-up bar 11 of the plate cylinder 1 in a rotational position opposite the tucking device 9.

In the rotational position of FIG. 3, the plate cylinder 1 has completed one revolution. The lock-up bar 11 is still in its extended position. Now the trailing edge 8 of the plate 6 has been pushed into the retainer spring of the lock-up bar 11 of the plate cylinder 1, and the leading edge of the plate 6 remains hooked over the outer end 25. The plate trailing edge is now held between the outer surface 16 of the lock-up bar 11 and the surface of the tucker bar 10. Upon rotational movement of the plate cylinder 1, the trailing edge 8 is pre-tucked into the lock-up bar 11 when the outer end 25 passes the upper corner 35 (the upper corner 35 is labelled in FIG. 5) of the tucker bar 10. In accordance with exemplary embodiments, a gap on the order of 0.236 inches can be provided between the plate cylinder 1 and the tucker bar 10, such that a bend in the pre-tucked trailing edge on the order of 0.25 can slip through the gap. This pre-tucking therefore allows for use of a relatively small gap between the tucker bar 10 and the lock-up bar 11. However, those skilled in the art will appreciate that such dimensions are by way of example only and that these dimensions, and/or relative dimensions, can be increased or decreased to accommodate any desired implementation.

Figure 4:
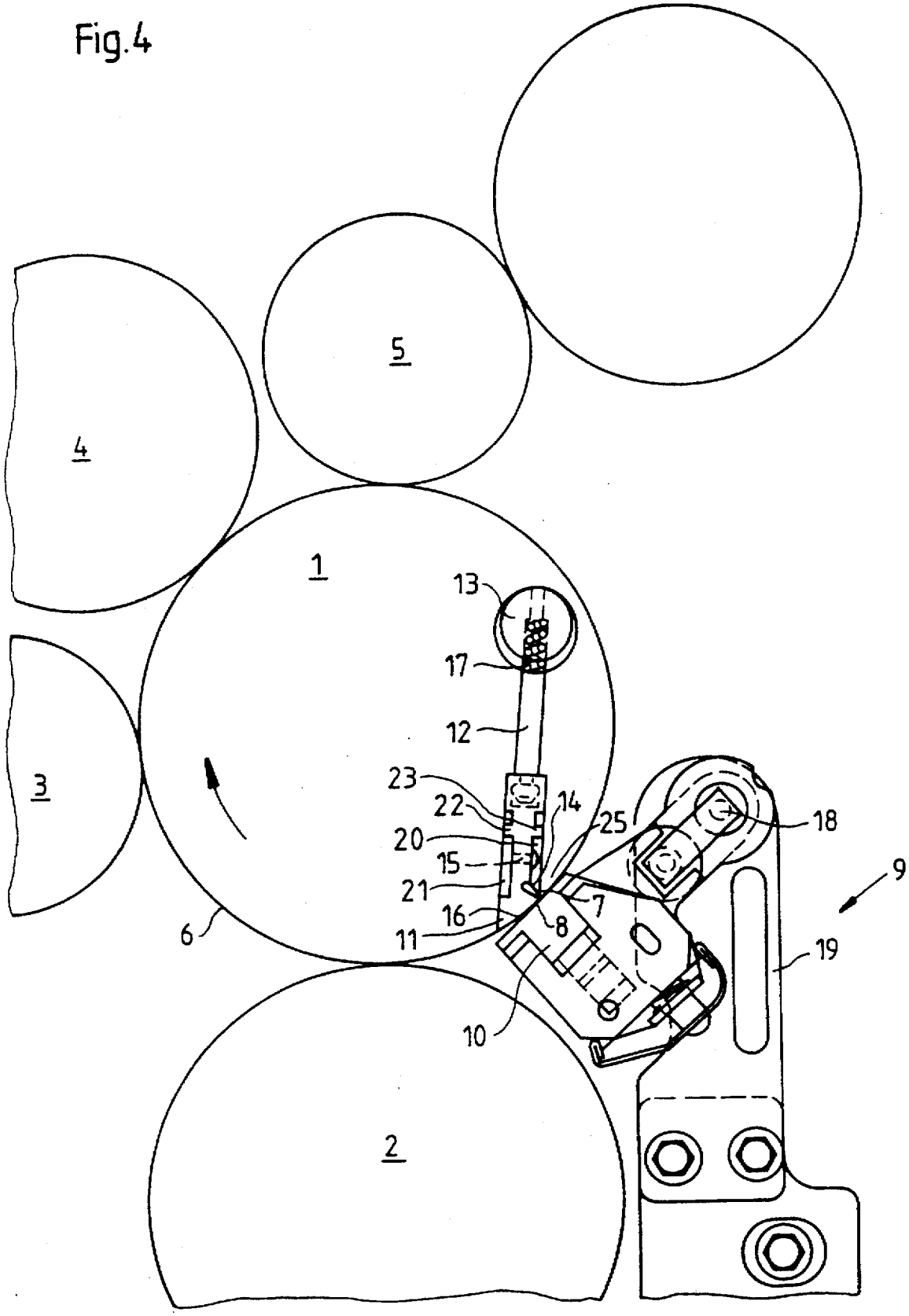
FIG. 4 shows the tucking device and the lock-up bar of FIG. 3 being activated to fix a trailing edge of the printing plate.

FIG. 4 shows the tucking device and the lock-up bar being activated to fix the leading and trailing edges of the plate 6 to be mounted on the plate cylinder.

In FIG. 4, the plate cylinder 1 is brought to a stop and the tucker bar 10 is energized—via fluid pressure, for example—to push the trailing edge 8 up against the outer surface 16 of the lock-up bar 11. The lock-up bar 11 itself is then retracted into the open passage 24 by means of the coil springs 17 acting upon the balance bar 13. While the lock-up bar 11 is retracting into the plate cylinder 1, the tucker bar 10 is still pushing against the trailing edge 8 of the plate to accomplish a smooth clamping of the plate on the circumference of the plate cylinder 1.

Figure 5:
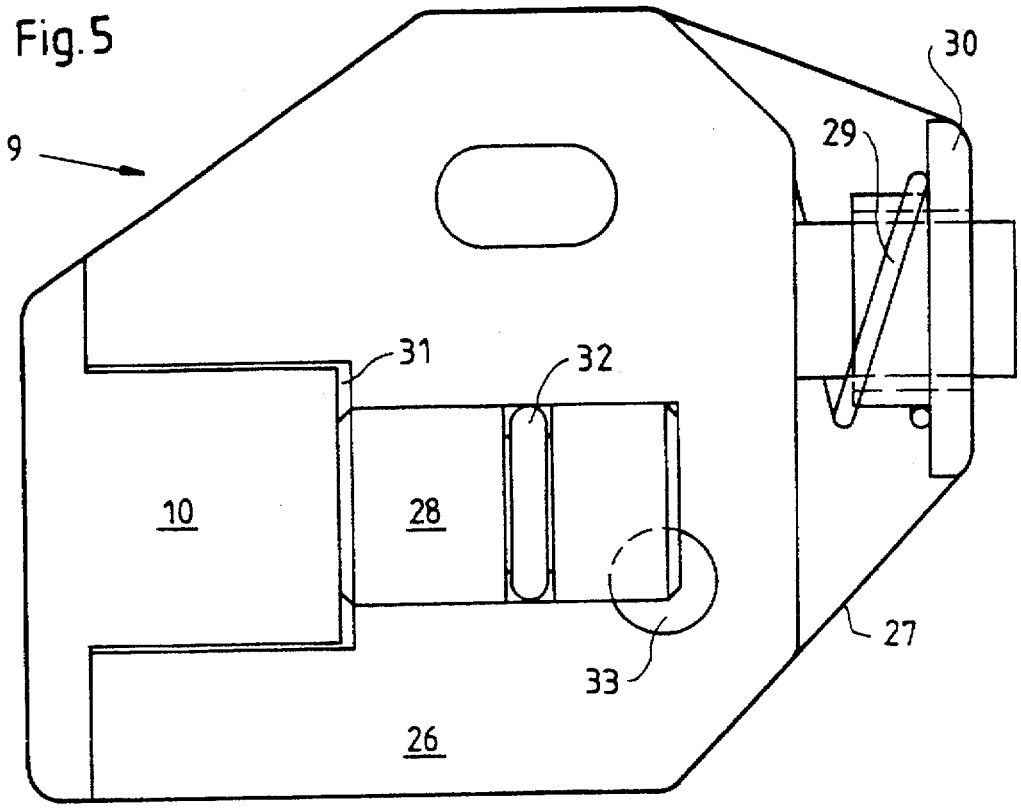
FIG. 5 shows an exemplary embodiment of the FIG. 4 tucking device in greater detail.

FIG. 5 shows the tucking device in greater detail in its inactivated, closed position.

In the exemplary FIG. 5 embodiment of the tucking device 9, the tucker bar 10 is mounted in a recess 31 of a housing 26. The housing 26 further comprises a spring-loaded tensioning plate 30. By means of the tensioning plate 30, a protection device—being, for example, shaped as a protective sleeve 27, formed of any flexible (for example, elastic) or rigid material—is held tightly around the tucking device 9 thereby encasing the tucking device. The housing 26 includes a supply bore 33 for supplying fluid pressure (for example, hydraulic or pneumatic pressure) to move a piston 28. The piston 28 is provided with a sealing means 32, such as an O-ring or the like. Referring to the FIG. 5 drawing, the left hand end of the piston 28 contacts the tucker bar 10, and the right hand end of the piston 28 faces a pressure chamber 34 (see FIG. 6).

Figure 6:
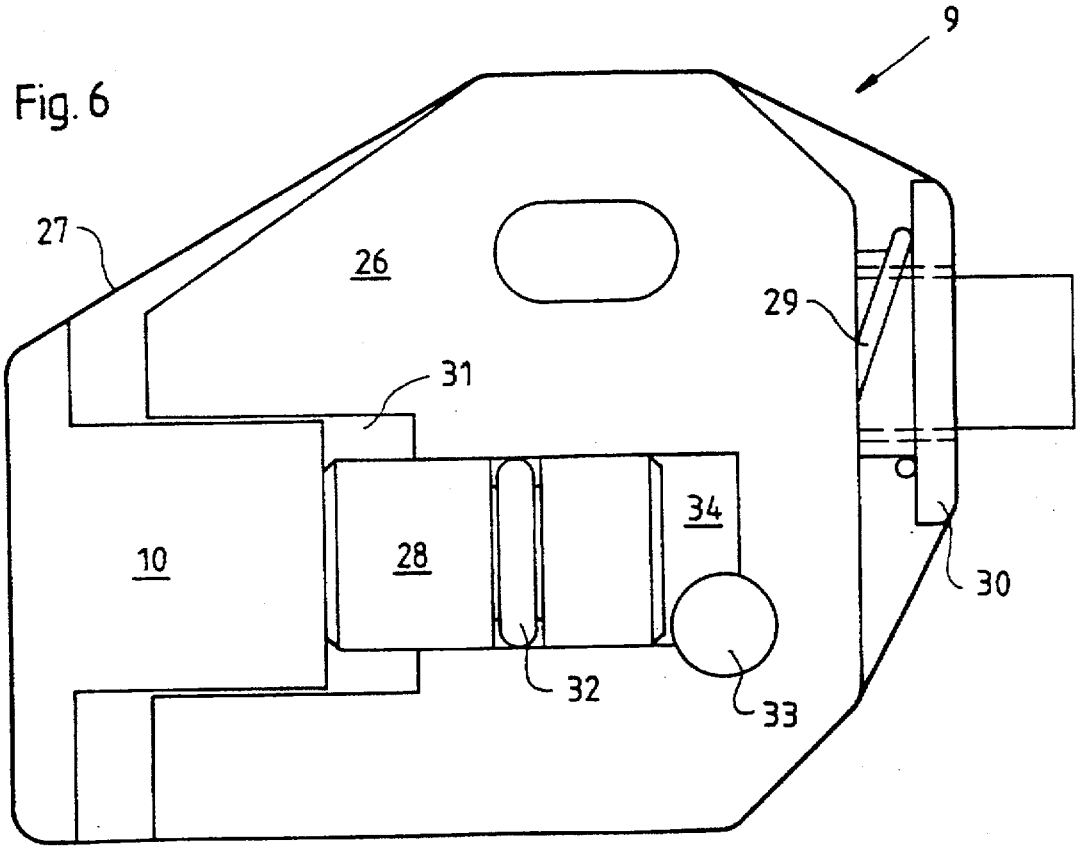
FIG. 6 shows the tucking device of FIG. 5 with a tucker bar in an activated position.

In FIG. 6 the piston is shown in an activated position. The supply bore 33 is used to supply a fluid pressure to the chamber 34. Thus, the piston 28 moves laterally, causing the tucker bar 10 to extend from the recess 31 and engage the trailing edge 8 of the plate 6. Upon lateral movement of the piston 28 and the tucker bar 10, the protective sleeve 27 is also extended. The protective sleeve 27 causes a spring 29 of the spring-loaded tensioning plate 30 to compress, and the tensioning plate 30 is moved accordingly in the lateral direction. Thus, the protective sleeve 27 is kept tightly wrapped around the housing 26 during outward extension of the tucker bar 10. The protective sleeve 27 seals out any contaminants from getting between the tucker bar 10 and the tucker bar housing 26. Especially, the edges of the tucker bar 10 and the edges of the recess 31 are protected. Due to the spring-loaded tensioning plate 30, the protective sleeve 27 is always—even during movement of the tucker bar 10—in a tightened condition, thus sealing tucker bar 10 against any contaminants such as ink, paper dust or the like.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for mounting a printing plate on a printing unit cylinder comprising:

a printing unit cylinder having an opening in a retaining area of said printing unit cylinder;

a lock-up bar slidably mounted in said opening of said printing unit cylinder, said lock-up bar having an element for retaining at least one edge of a printing plate; and a tucking device assigned to said printing unit cylinder and having a tucker bar substantially covering the retaining area of said printing cylinder, said tucking device being provided with a protection device.

2. Apparatus according to claim 1, wherein said tucking device urges at least one of a leading edge and a trailing edge of a printing plate into said lock-up bar of said plate cylinder.

3. Apparatus according to claim 1, wherein said lock-up bar is retractable into said opening of the plate cylinder, and wherein said lock-up bar further includes:

a surface which is contacted by said tucker bar during retraction of the lock-up bar into said plate cylinder.

4. Apparatus according to claim 1, wherein said protection device further includes:

a protective sleeve.

5. Apparatus according to claim 4, wherein said protective sleeve is made of an elastic material.

6. Apparatus according to claim 4, wherein said protective sleeve is made of a rubber-like material.

7. Apparatus according to claim 4, wherein said protective sleeve is made of a polyester/polyurethane layer.

8. Apparatus according to claim 4, wherein said protective sleeve is made of fabric material.

9. Apparatus according to claim 4, further comprising:

a spring-loaded tensioning plate for applying tension to said protective sleeve.

10. Apparatus according to claim 4, wherein said protective sleeve substantially wraps said tucker bar, said tucking device further including:

a housing having a recess in which said tucker bar is slidably mounted.

11. Apparatus according to claim 1, wherein said tucking device further includes:

a housing having a pressure chamber.

12. Apparatus according to claim 11, wherein said pressure chamber further includes:

a movably mounted piston.

13. Apparatus according to claim 12, wherein said housing further includes:

a recess wherein said piston moves said tucker bar.

14. Apparatus according to claim 11, wherein said pressure chamber applies hydraulic pressure to said tucker bar.

15. Apparatus according to claim 11, wherein said pressure chamber applies pneumatic pressure to said tucker bar.

16. Apparatus according to claim 4, wherein said protective sleeve is made of a rigid material.

17. Apparatus according to claim 4, wherein said protective sleeve is made of a composite material.

18. Apparatus for mounting a printing plate on a printing unit cylinder comprising:

a printing unit cylinder having an opening in a retaining area of said printing unit cylinder for receiving a leading edge and a trailing edge of a printing plate;

a lock-up bar slidably mounted in said opening of said printing unit cylinder for retaining at least one of said leading edge and said trailing edge of said printing plate; and a tucking device having a tucker bar for contacting at least one of said leading edge and said trailing edge of said printing plate during lock-up of said trailing edge within said opening.

19. Apparatus according to claim 18, wherein said tucking device further includes:

a housing having a movable piston mounted therein for contacting said tucker bar, said piston extending said tucker bar from said housing during activation thereof; and a protective sleeve for encasing said tucker device during deactivation and activation of said piston.

20. Apparatus according to claim 19, further comprising:

a spring-loaded tensioning plate for applying tension to said protective sleeve.

21. Apparatus according to claim 20, wherein said protective sleeve is made of an elastic material.

22. Apparatus according to claim 20, wherein said protective sleeve is made of a rigid material.

23. Method for mounting a printing plate on a printing unit cylinder comprising the steps of:

inserting a leading edge of a printing plate into a retaining area formed as an opening in a printing unit cylinder;

retaining said leading edge of said printing plate with a lock-up bar slidably mounted in said opening of said printing unit cylinder;

pre-tucking a trailing edge of the printing plate into the lock-up bar; and contacting said trailing edge of said printing plate with a tucker bar of a tucking device which urges the trailing edge toward said opening.

24. Method according to claim 23, further including a step of:

automatically extending the lock-up bar from plate cylinder while the plate cylinder is rotating after said steps of inserting and retaining said leading edge but before said step of pre-tucking said trailing edge.

25. Apparatus for mounting a printing plate on a printing unit cylinder comprising:

a printing unit cylinder having an opening in a retaining area of said printing unit cylinder; and a tucking device assigned to said printing unit cylinder and having a tucker bar substantially covering said retaining area of said printing cylinder, said tucking device being provided with a protection device, wherein said protective device further includes a protective sleeve.

26. Apparatus according to claim 25, wherein said protective sleeve is made of an elastic material.

27. Apparatus according to claim 25, wherein said protective sleeve is made of a rubber-like material.

28. Apparatus according to claim 25, wherein said protective sleeve is made of a polyester/polyurethane layer.

29. Apparatus according to claim 25, wherein said protective sleeve is made of an elastic fabric material.

30. Apparatus according to claim 25, wherein said protective sleeve is made of a rigid material.

31. Apparatus according to claim 25, wherein said protective sleeve is made of a composite material.

* * * * *